US011365910B2

(12) United States Patent
Erfurth et al.

(10) Patent No.: US 11,365,910 B2
(45) Date of Patent: Jun. 21, 2022

(54) COOLING MODULE

(71) Applicant: VIESSMANN WERKE GMBH & CO. KG, Allendorf (DE)

(72) Inventors: Florian Erfurth, Hof (DE); Bernd Gebelein, Geroldsgruen (DE); Daniel Grossmann, Hof (DE); Michael Stein, Weischlitz (DE); Niklas Viehmann, Schoettengrund (DE)

(73) Assignee: VIESSMANN WERKE GMBH & CO. KG

( * ) Notice: Subject to any disclaimer, the term of this patent is extended or adjusted under 35 U.S.C. 154(b) by 449 days.

(21) Appl. No.: 16/317,773

(22) PCT Filed: Jul. 12, 2017

(86) PCT No.: PCT/EP2017/067496
§ 371 (c)(1),
(2) Date: Jan. 14, 2019

(87) PCT Pub. No.: WO2018/011246
PCT Pub. Date: Jan. 18, 2018

(65) Prior Publication Data

US 2019/0234659 A1 Aug. 1, 2019

(30) Foreign Application Priority Data

Jul. 13, 2016 (DE) ..... 10 2016 112 851.1

(51) Int. Cl.
*F25B 30/02* (2006.01)
*F25D 23/00* (2006.01)

(52) U.S. Cl.
CPC ..... *F25B 30/02* (2013.01); *F25D 23/00* (2013.01); *F25B 2500/06* (2013.01)

(58) Field of Classification Search
CPC .. F25B 7/00; F25B 30/02; F25B 23/00; F25B 23/006; F25B 2500/06; F25B 2500/22; F25B 2500/221; F25B 2500/222
See application file for complete search history.

(56) References Cited

U.S. PATENT DOCUMENTS 4,400,950 A * 8/1983 Knabben ..... F24D 11/0214 62/238.6
4,766,732 A * 8/1988 Rubin ..... F25D 3/12 62/384

(Continued)

FOREIGN PATENT DOCUMENTS

CH 704990 11/2012 ..... B23P 12/00
DE 2807990 8/1979 ..... F25B 30/04

(Continued)

OTHER PUBLICATIONS

International Preliminary Report on Patentability issued in application No. PCT/EP2017/067496, dated Jan. 15, 2019 (14 pgs).

(Continued)

*Primary Examiner* — Miguel A Diaz
(74) *Attorney, Agent, or Firm* — Hayes Soloway P.C.

(57) ABSTRACT

Disclosed is a cooling module having a first fluid circuit with a cold generator, the components of the first fluid circuit being arranged in an insulated housing. At least one component of the first fluid circuit is coupled to at least one section of a second fluid circuit, which section runs in the housing, wherein said housing includes connections for the at least one second fluid circuit, and a negative pressure prevails in the housing.

10 Claims, 3 Drawing Sheets

(56) References Cited

U.S. PATENT DOCUMENTS

| | | | | |
|---|---|---|---|---|
| 9,759,433 | B2 * | 9/2017 | Hahn | F24D 3/08 |
| 2012/0291457 | A1 * | 11/2012 | Brown | G01M 3/3227 62/77 |
| 2014/0216077 | A1 * | 8/2014 | Albert | F25B 7/00 62/79 |
| 2014/0216099 | A1 * | 8/2014 | Meister | F25D 31/006 62/440 |
| 2015/0128614 | A1 * | 5/2015 | Ghoshal | F24H 4/04 62/3.3 |
| 2017/0071381 | A1 * | 3/2017 | Ze | B65D 81/3844 |
| 2018/0081011 | A1 * | 3/2018 | Wikus | F25D 19/006 |
| 2019/0234659 | A1 * | 8/2019 | Erfurth | F25B 30/02 |
| 2020/0173686 | A1 * | 6/2020 | Takagi | F24H 1/18 |
| 2020/0292213 | A1 * | 9/2020 | Scharf | F25B 21/00 |

FOREIGN PATENT DOCUMENTS

| | | | | |
|---|---|---|---|---|
| DE | 9106051 | | 12/1991 | F25B 29/00 |
| DE | 102008003630 | | 7/2009 | F24F 5/00 |
| DE | 102009029392 | | 3/2011 | F25B 29/00 |
| DE | 102012112347 | | 6/2014 | F01K 25/10 |
| DE | 102014112545 | | 3/2016 | B60H 1/00 |
| DE | 102014217108 | | 3/2016 | F01N 3/10 |
| DE | 202016103305 | U1 * | 7/2016 | F25B 49/005 |
| DE | 102016111292 | A1 * | 12/2017 | F25B 40/04 |
| EP | 0660055 | | 6/1995 | B60H 1/00 |
| EP | 3106780 | | 12/2016 | F25B 15/04 |
| FR | 2827948 | A1 * | 1/2003 | F25B 30/02 |
| WO | WO03010473 | | 2/2003 | B08B 15/02 |
| WO | WO2006052195 | | 5/2006 | F25B 49/00 |
| WO | WO2012159826 | | 11/2012 | F25B 31/02 |

OTHER PUBLICATIONS

International Search Report and Written Opinion issued in application No. PCT/EP2017/067496, dated Oct. 9, 2017 (18 pgs).

German Official Action issued in related Application Serial No. 10 2016 112 851.1, dated Mar. 29, 2017 with machine translation (13 pages).

German Official Action issued in related Application Serial No. 10 2016 112 851.1, dated May 14, 2019 with machine translation (11 pages).

* cited by examiner

COOLING MODULE

A refrigerating module comprising a first fluid circuit with a coldness generator is described, wherein the components, which conduct a first fluid, of the first fluid circuit are arranged in an insulated housing.

The first fluid can be, for example, a so-called refrigerant which is conducted in a refrigerant circuit, i.e. the first fluid circuit. Environmentally friendly refrigerants are usually combustible and/or toxic. Since refrigerants of that kind have to be monitored during use it has already been proposed to screen off relative to the environment all refrigerant-conducting components of a refrigerant circuit in a special housing.

In addition, it is necessary to provide a detection device which detects escape of a combustible and/or toxic refrigerant. An explosion-proof refrigerating plant with combustible refrigerant is known from DE 10 2009 029 392 A1, which comprises a housing in which the refrigerant-conducting components not safeguarded against explosion and the connecting elements thereof are received as a cohesive unit. In addition, a suction device and a gas sensor are provided within the housing, wherein the suction device comprises a fan, which is constructed to be protected against explosion, and if a predetermined concentration of refrigerant gas within the housing is reached all components arranged within the housing are switched off and separated from the power supply and operation of the explosion-safeguarded fan is triggered.

DE 91 06 051 U1 discloses a refrigerating or heating unit with a circuit which has a refrigerant and which is coupled with a second circuit and wherein the refrigerant circuit is received in a refrigerant-tight container, which after detection of escape of refrigerant hermetically seals the container.

The devices known from the prior art comprise a multiplicity of components required for detection of escape of refrigerant. The known systems seal a housing only after detection of a refrigerant or active ventilating devices, which conduct out the refrigerant gas escaping within the housing.

Accordingly, the object consists of indicating a refrigerating module which, with a smallest possible constructional space, prevents escape of a first fluid, for example refrigerant, into an environment surrounding the refrigerating module, wherein escape of the first fluid, for example refrigerant, can be recognised rapidly and in simple manner and the refrigerating module is in addition of simple construction.

SUMMARY OF THE DISCLOSURE

A refrigerating module fulfilling the aforesaid object comprises a first fluid circuit with a coldness generator, wherein:

- the components of the first fluid circuit are arranged in an insulated housing,
- at least one component of the first fluid circuit is coupled with at least one section, which is guided in the housing, of a second fluid circuit,
- the housing has connections for the at least one second fluid circuit, and
- a sub-atmospheric pressure prevails in the housing.

All components of the first fluid circuit are arranged within the insulated housing so that in the case of escape of the first fluid, which is, for example, a refrigerant, this does not pass into the environment. For transfer of the 'coldness', which is generated by the coldness generator, to a cooling device arranged outside the refrigerating module the refrigerating module has a heat exchanger which undertakes transmission of the 'coldness' to at least one section of a second fluid circuit. This section of the second fluid circuit is similarly arranged within the insulated housing. The connections for the at least one second fluid circuit are inserted into the housing to be hermetically sealed. The refrigerating module has further hermetically sealed connections, for example for electronic components and conveying devices within the refrigerating module. The coupling of the refrigerating module to the corresponding devices, for example second fluid circuit, power supply, etc., takes place by way of the connections.

The first fluid circuit can be a refrigerant circuit in which a refrigerant as first fluid is conducted. The second fluid circuit can be a coolant circuit in which a coolant as second fluid is conducted. In particular, the first fluid of the first fluid circuit, for example a refrigerant, can be combustible and/or toxic. Conversely, the second fluid of the second fluid circuit, for example a coolant, can be non-toxic and/or non-combustible so that escape of the second fluid does not represent a risk for people and animals.

Several advantages arise from the fact that a sub-atmospheric pressure prevails in the housing. On the one hand, escape of the first fluid, for example escape of refrigerant, can be detected very rapidly. Escape of the first fluid can also be, for example, optically visible, since deformation of the outer casing of the housing can occur. In addition, provision of a sub-atmospheric pressure within the housing allows a very tight arrangement of the components within the refrigerating module, since there is no or only a very small heat transfer within the refrigerating module. The construction of a refrigerating module as a sub-atmospheric pressure chamber additionally prevents ignition of escaping refrigerant gas within the housing.

The refrigerating module makes it possible to arrange all components of the first fluid circuit in a very small space without these being subject to substantial mutual thermal influencing. In addition, due to the small volume within the housing, escape of the first fluid can be detected very quickly. In the case of conventional devices from the prior art, in which a pressure of substantially one bar prevails within a housing, the components have to be arranged at a mutual spacing or be insulated so that these do not thermally influence one another. As a result, the devices known from the prior art are of correspondingly large construction and a certain time elapses until escape of refrigerant can be detected by way of, for example, pressure sensors. In the case of the refrigerating module described herein the volume enclosed by the housing is significantly smaller so that small pressure differences can be very rapidly detected. In addition, the refrigerating module is safeguarded against explosion, since as a consequence of the sub-atmospheric pressure or preferably the construction as a sub-atmospheric pressure chamber the amount of energy within the refrigerating module for ignition of the gas mixtures present therein is very small. The probability of an explosion is therefore very small. In particular, the state of capability of explosion of the gas mixtures therein due to the escape of the first fluid would very rapidly pass.

In preferred forms of embodiment a very high level of sub-atmospheric pressure substantially prevails within the refrigerating module. A very high level of sub-atmospheric pressure means that the pressure within the housing is significantly lower than the pressure outside the housing. However, depending on the first fluid used and the place of use as well as the materials employed a sub-atmospheric pressure with a pressure in the range of 0.9 bars to 0.1 bars relative to an atmospheric pressure of approximately 1 bar can also be set.

The housing of the refrigerating module can consist of a solid material. For example, the housing can consist of metal side walls tightly connected together. In addition, connections can be provided in order to produce sub-atmospheric pressure. Further, an access opening can be provided in order, after pressure equalisation, to exchange components of the first fluid circuit or the first fluid.

In further forms of embodiment the housing comprises a support structure and at least one barrier film. The barrier film prevents issue of first fluid or first fluid gas, for example refrigerant gas, which escapes from the first fluid circuit. Moreover, substance exchange can be substantially completely prevented by way of at least one barrier film. In addition, barrier films can also provide heat insulation and prevent entry of light. The support structure can be formed by, for example, a metal frame. In that case, particular attention is to be given to the fact that the barrier film is not damaged by the support structure.

In addition, the housing can surround a support core, in which case the support core surrounds the components of the first fluid circuit. A support core is provided particularly in the case of construction of the housing with a support structure and at least one barrier film. The support core prevents compressing of the barrier film due to the sub-atmospheric pressure, which by itself has nothing to counteract the externally acting pressure. The support core can be made from different materials. In particular, the support core is so constructed and arranged that the components of the first fluid circuit are surrounded by the material of the support core. The support core can be produced, for example, by surrounding the components of the first fluid circuit by foam and subsequently sealing them by the barrier film. In further forms of embodiment the afore-mentioned support structure can be formed by the support core.

In further forms of embodiment the support core consists of an evacuatable non-combustible material. Evacuatable materials as support core for heat insulation are known, for example in building technology, and can be similarly used for the refrigerating module. A non-combustible material for the support core additionally improves the safety of the refrigerating module in the case of escape of the first fluid.

At least one device, for example a sensor, for detecting physical variables can be arranged in the housing. Various variables referring to escape of the first fluid, for example the refrigerant, can be detected by at least one device for detection of physical variables. A device for detection of physical variables can in that case be constructed so that it detects only one variable or detects a plurality of variables. Moreover, a device for detection of physical variables can be so constructed that it processes the detected data and passes on the processed data as signals, for example to a control device, which then triggers an alarm or initiates other measure.

In the case of the refrigerating module described herein with a barrier film the escape of the first fluid can be immediately detected through deformation of the barrier film, for example through formation of bubbles. In further forms of embodiment at least one sensor device for detection of escaping refrigerant from the refrigerant circuit is arranged in the housing as a device for detecting physical variables. The sensor device can be, for example, a pressure sensor. The escape of the first fluid can be detected very rapidly by virtue of the small volume due to the construction of the refrigerating module as a sub-atmospheric pressure chamber.

The refrigerating module can additionally comprise a control device or be coupled with an external control device which communicates the escape of the first fluid or of refrigerant by way of an appropriate interface between the refrigerating module and the external control unit. In such a case, operation of the coldness generator can be interrupted by way of an internal and external control unit. In addition, further measures concerning, for example, the devices or installations coupled to the coldness generator by way of a coolant circuit can be employed.

The coldness generator can comprise a compressor, an evaporator, a catalyser and an expansion valve. The coldness generator can be constructed as, in particular, a so-called heat pump.

In further forms of embodiment the condenser is coupled to at least one section, which is guided in the housing, of a third fluid circuit, for example a heating medium circuit. The section of the heating medium circuit guided within the refrigerating module is coupled by way of heat exchanger or a heat exchange device to the condenser or the first fluid circuit. The heat delivered by way of the condenser can thus be conducted by way of the third fluid circuit or the heating medium circuit to the outside and used for, for example, heating rooms or installations. Alternatively thereto or additionally the evaporator is coupled to the at least one second fluid circuit by way of the section guided in the housing, wherein the guided section is coupled by way of a heat exchanger or a heat exchange device to the evaporator of the first fluid circuit and thus the second fluid conducted in the second fluid circuit is cooled. The second fluid is fed by way of the connections to further elements of a second fluid circuit, by way of which cooling of rooms, refrigerators or other equipment is possible.

The compressor of the coldness generator of the refrigerating module can, for cooling, be coupled to a separate fluid circuit, for example a separate cooling circuit, which is led out of the housing by way of appropriate connections. The cooling circuit can comprise, for example, a cooling device with cooling ribs arranged outside the refrigerating module. In addition, a further cooling liquid serving for cooling the compressor can be conducted in the cooling circuit. This is introduced by way of the connections into the housing of the refrigerating module and in that case produces cooling of the compressor by take up of heat.

In further forms of embodiment the compressor can, for cooling, be coupled to the evaporator. The second fluid conducted in the evaporator or conducted between the evaporator and the compressor has a lower temperature. In order to perform cooling of the compressor, a heat exchanger is provided in the region of the first fluid circuit, for example upstream of the compressor with a lower temperature, and taps off the 'coldness' of the first fluid and utilises it at least partly for cooling the compressor.

Cooling of the compressor within the refrigerating module is thereby provided. This further simplifies the refrigerating module and makes it possible to use it universally.

An advantage of the refrigerating module described herein is that this can have small dimensions, as a result of which detection of leakages can take place very rapidly due to the limited volume. Moreover, escaping first fluid is retained in the housing and cannot pass into the free space or the environment. Further, the refrigerating module can be exchanged by way of the connections without opening the first fluid circuit or the housing ('plug and play').

BRIEF DESCRIPTION OF THE DRAWINGS

Further advantages, features and possibilities of embodiment are evident from the following figure description of embodiments, which are to be understood as non-limiting.

In the drawings.

Figure 1:
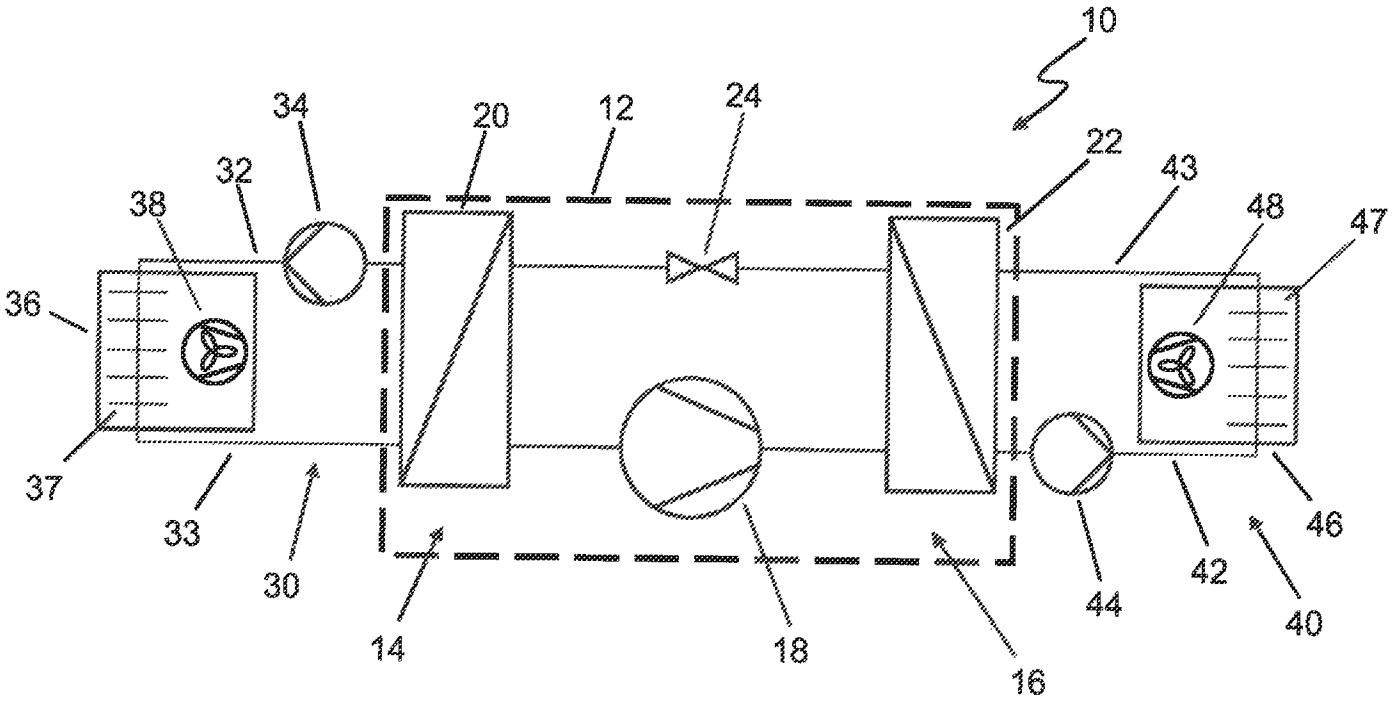
FIG. 1 shows a schematic illustration of a refrigerating module which is coupled to a refrigerant circuit and a heating medium circuit.

In the drawings, parts provided with the same reference numerals substantially correspond with one another insofar as nothing to the contrary is indicated. Moreover, description of components substantially not required for an understanding the technical teaching disclosed herein has been dispensed with.

In the following description of figures, refrigerating modules 10 are described which comprise a refrigerant circuit 16 as a first fluid circuit, a coolant circuit 30 as a second fluid circuit and a heating medium circuit 40 as a third fluid circuit. However, this does not constitute a limitation of the teaching described herein, since other fluids instead of coolants, refrigerants and heating media can be used without departing from the essence of the technical teaching described herein.

DETAILED DESCRIPTION OF THE DISCLOSURE

FIG. 1 shows a schematic illustration of a refrigerating module 10, which is coupled to a coolant circuit 30 and a heating medium circuit 40. The refrigerating module 10 comprises a housing 12, which in one form of embodiment is a solid steel housing. In a further form of embodiment the housing 12 comprises a support structure and a barrier film surrounding the support structure. The support structure can enclose a support core or be formed by the support core itself. A support core is made out of an evacuatable non-combustible material. In addition, the housing 12 can also comprise a cladding surrounding the barrier film.

The housing 12 of the refrigerating module 10 surrounds a refrigerant circuit 16. A refrigerant which is combustible and/or toxic is conducted in the refrigerant circuit 16. For this reason it has to be ensured that in the event of leakage in the refrigerant circuit 16 no refrigerant is delivered to the environment. Accordingly, the housing 12 is constructed to be insulating and does not permit escape of refrigerant.

The refrigerant circuit 16 comprises a compressor 18. The refrigerant is compressed in the compressor 18 and fed to a condenser 22. The condenser 22 is coupled to a heat exchanger by way of which the heat of the refrigerant can be transferred to the heating medium circuit 40. The refrigerant is fed from the condenser 22 to the evaporator 20 by way of an expansion valve 24 in which the refrigerant expands, in which case the pressure of the refrigerant decreases and the refrigerant cools down and partly evaporates. The evaporator 20 takes up heat from the coolant circuit 30 by way of a heat exchanger and in that case causes cooling of the coolant conducted in the coolant circuit. The refrigerant in the refrigerant circuit 16 is in that case heated.

A brine or a water in the heating medium circuit 40 and a brine in the coolant circuit 30 are thus not in direct contact with the refrigerant. The transfer of the thermal energy of the refrigerant always takes place by way of heat exchangers. The heat exchangers are arranged in the housing 12. For that purpose the housing 12 additionally has connections, which are not illustrated in FIGS. 1 and 2 and by way of which the coolant circuit 30 and the heating medium circuit 40 can be connected with corresponding sections fixedly installed in the housing 12.

The coolant circuit 30 has in the forward run 32 a fluid conveying device, for example a pump 34, which in further embodiments can be a speed-regulated pump 34. In the following embodiment the fluid conveying device is a speed-regulated pump 34, wherein other fluid conveying devices can also be used instead of a pump 34 without departing from the essence of the technical teaching described herein.

In addition, the coolant circuit 30 comprises a cooling device 36 with a heat exchanger 37 and a fan 38. Rooms or refrigerators, for example, can be cooled by way of the cooling device 36, wherein the coolant in the coolant circuit 30 takes up heat. The heated coolant is conducted into the refrigerating module 10 by way of the return 33 and a corresponding connection in the housing 12. Cooling by way of a heat exchanger and the evaporator 20 takes place therein.

The heating medium circuit 40 is connected by a forward run 42 by way of a corresponding connection with a corresponding section guided in the housing 12. A fluid conveying device is disposed in the forward run 42. The fluid conveying device can be a pump 44, for example a speed-regulated pump 44. In the following embodiment the fluid conveying device is a speed-regulated pump 44, wherein instead of a pump 44 use can also be made of different fluid conveying devices without departing from the essence of the technical teaching described herein.

A heated brine or a heated water is fed by way of the speed-regulated pump 44 to a heating device 46. The heating device 46 comprises a heat exchanger 47 and a fan 48. It is possible, for example, to heat a room by way of the heating device 46. The water conducted in the heating medium circuit 40 in that case cools down and is conducted by way of the return 43 back to the refrigerating module 10, in which case heating of the heating medium takes place therein by way of a heat exchanger and the condenser 22.

The coolant circuit 30 and the heating medium circuit 40 can comprise further cooling devices 36 and heating devices 46, which can also be divided into further fluid sub-flows. In addition, further conveying devices such as, for example, speed-regulated pumps, valves, speed and temperature measuring devices and further devices required for those purposes can be provided.

By comparison with devices known from the prior art, a sub-atmospheric pressure prevails in the interior space 14 in the refrigerating module 10. A high level of sub-atmospheric pressure is preferably generated in the interior space 14. The sub-atmospheric pressure makes it possible to arrange the components of the refrigerant circuit 16, for example compressor 18, evaporator 20, condenser 22 and expansion valve 24, physically adjacent to one another without a resultant high transfer of heat between the components. Consequently, there is a further advantage, since the housing 12 has small dimensions and the interior space 14 has a small volume. If a refrigerant escapes from the refrigerant circuit 16 then due to the small volume of the interior space 14 the escape can be clearly recognised more quickly than in the case of large-volume devices. In addition, in the cases of construction of the housing 12 with a barrier film, escape of refrigerant can be recognised just through deformation of the film.

Figure 2:
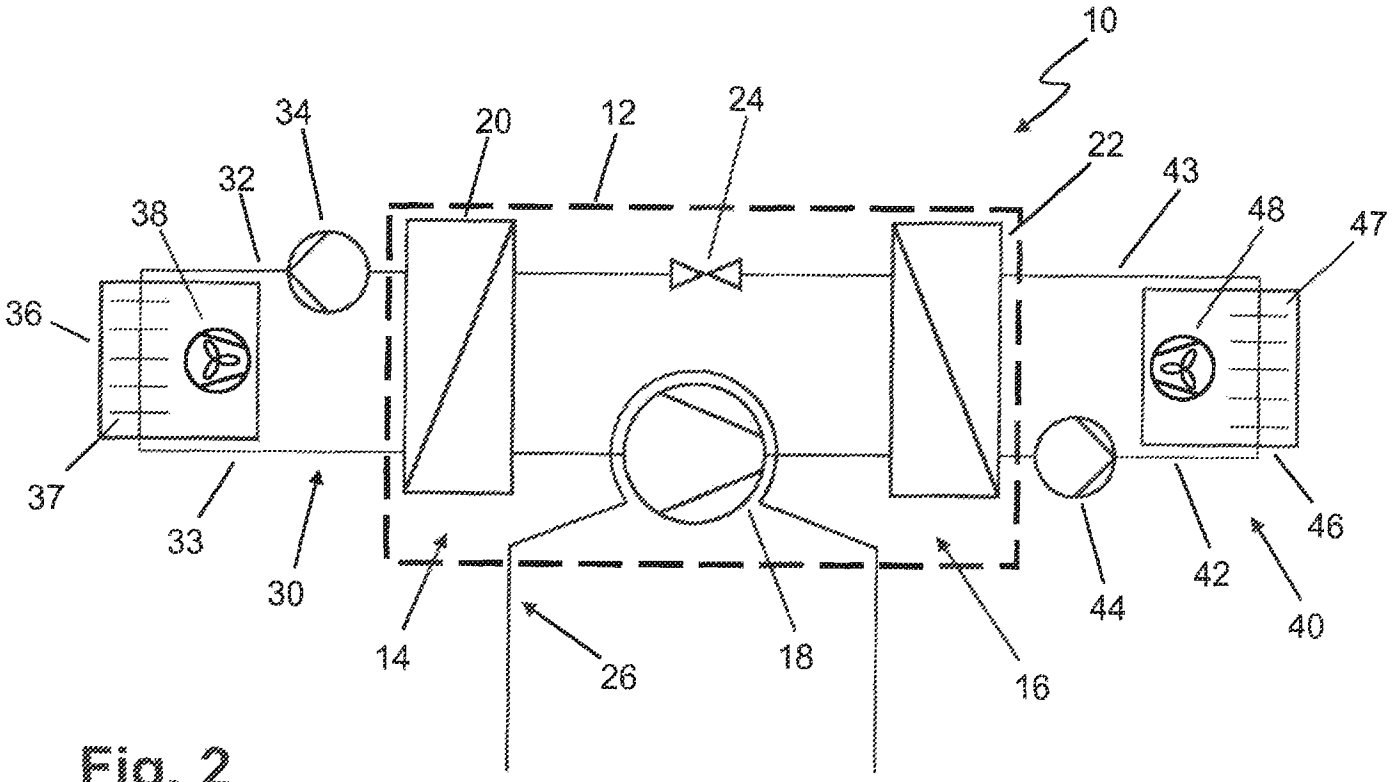
FIG. 2 shows a farther refrigerating module which is coupled to a coolant circuit and a heating medium circuit.

In addition, in departure from the illustration in FIGS. 1 and 2, a device for detection of physical variables can be provided at a refrigerating module 10. The device for detection of physical variables can be, for example, a sensor device which detects escape of refrigerant. For example, the sensor device is a pressure sensor which reacts to small pressure differences and emits an alarm. Alternatively or additionally to emitting an alarm, switching-off of the compressor 18 can also be undertaken by way of a control device.

Moreover, due to the fact that a sub-atmospheric pressure prevails in the interior space 14 a combustible air and refrigerant gas mixture cannot form or the gas mixture contained therein very rapidly passes through the state of capability of explosion. If the housing 12 comprises a barrier film and a support core of an evacuatable non-combustible material an explosion-safeguarded arrangement is similarly provided.

In that case, the provision of sub-atmospheric pressure in the interior space 14 offers several advantages, since the housing 12 or the refrigerating module 10 can be constructed to be of very small form, no additional insulation of the components of the refrigerant circuit 16 is required in view of the fact that no transfer of heat or only a very small transfer of heat takes place within the housing 12, detection of escaping refrigerant is possible in a very rapid and simple manner due to the small volume and the low pressure, and escaping refrigerant is prevented by way of the sealed construction of the housing 12 with insulation.

The housing 12 has appropriate connections which are hermetically arranged in the housing 12. By way of the connections it is possible, for example, to realise a signal line for a bidirectional communication with the components of the refrigerant circuit 16, an internal control unit and/or a sensor device such as, for example, a pressure sensor. In addition, the housing 12 has connections for the coolant circuit 30 and the heating medium circuit 40. Sections of a coolant circuit and a heating medium circuit extend from these connections by way of a heat exchanger so that the heat/coldness provided by way of the refrigerant circuit 16 can be conducted by way of the refrigerant to the outside. The refrigerating module 10 can thus be connected by means of 'plug and play' to already existing cooling and heating plants.

FIG. 2 shows a further schematic construction of a refrigerating module 10, which is similarly coupled to a coolant circuit 30 and a heating medium circuit 40.

In the case of the refrigerating module 10 shown in FIG. 2, cooling of the compressor 18 takes place by way of a separate cooling circuit 26, which is led out of the housing 12. Connections, which are similarly not denoted, are provided for that purpose. A further coolant which is, for example, cooled by ambient air by way of a plate heat exchanger can be conducted in the cooling circuit. In addition, a conveying device which conveys a coolant conducted in the cooling circuit 26 can also be provided.

Instead of external cooling of the compressor 18, internal cooling of the compressor 18 can also be achieved. For that purpose, for example, a heat exchanger, which supplies heat to the refrigerant and thus causes cooling of the compressor 18, is arranged in the region of the evaporator 20. A further conveying device can be provided for such an internal additional cooling circuit.

Figure 3:
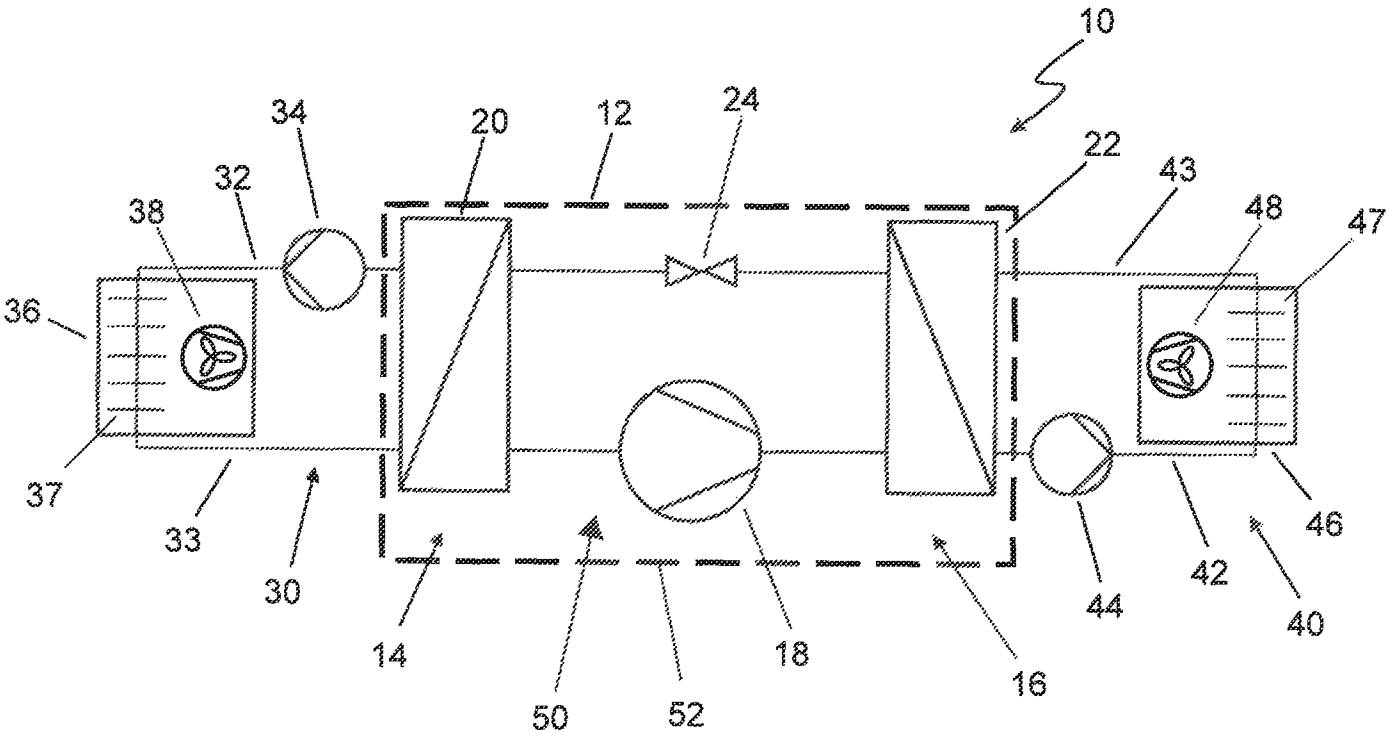
FIG. 3 shows yet another refrigeration module according to the present disclosure.

FIG. 3 shows a schematic illustration of another embodiment of a refrigerating module 10, which is coupled to a coolant circuit 30 and a heating medium circuit 40. The refrigerating module 10 comprises a housing 12, which in one form of embodiment is a solid steel housing. The FIG. 3 embodiment is similar to the FIG. 1 embodiment, in which, however, the housing 12 comprises a support structure 50 and a barrier film 52 surrounding the support structure. The support structure can enclose a support core or be formed by the support core itself. A support core is made out of an evacuatable non-combustible material. In addition, the housing 12 can also comprise a cladding surrounding the barrier film.

REFERENCE NUMERAL LIST

10 refrigerating module
12 housing
14 interior space
16 refrigerant circuit
18 compressor
20 evaporator
22 condenser
24 expansion valve
26 cooling circuit
30 coolant circuit
32 forward run
33 return run
34 pump
36 cooling device
37 heat exchanger
38 fan
40 heating medium circuit
42 forward run
43 return run
44 pump
46 heating device
47 heat exchanger
48 fan

The invention claimed is:

1. A refrigerating module comprising a first fluid circuit with a coldness generator, wherein components of the first fluid circuit are arranged in an insulated hermetically closed housing, at least one component of the components of the first fluid circuit is coupled with at least one section, which is guided in the housing, of a second fluid circuit, the housing has hermetically sealed connections for the at least one second fluid circuit, a sub-atmospheric pressure prevails in the housing, the components have a tight arrangement within the housing, wherein the components are physically adjacent to one another without the components being subject to a mutual thermal influencing between the components, wherein the housing comprises a support structure and at least one barrier film, wherein the housing surrounds a support core and the support core surrounds the components of the first fluid circuit, wherein the support core forms the support structure, and wherein the support core is configured to prevent compressing of the barrier film due to the sub-atmospheric pressure.

2. The refrigerating module according to claim 1, wherein at least one sensor for detection of physical variables is arranged in the housing, and wherein the at least one sensor is associated with a control device.

3. The refrigerating module according to claim 2, wherein the coldness generator comprises a compressor, an evaporator, a condenser and an expansion valve.

4. The refrigerating module according to claim 1, wherein the support core is formed of an evacuatable non-combustible material.

5. The refrigerating module according to claim 4, wherein at least one sensor for detection of physical variables is arranged in the housing, and the at least one sensor is associated with a control device.

6. The refrigerating module according to claim 4, wherein the coldness generator comprises a compressor, an evaporator, a condenser and an expansion valve.

7. The refrigerating module according to claim 1, wherein the coldness generator comprises a compressor, an evaporator, a condenser and an expansion valve.

8. The refrigerating module according to claim 7, wherein
the condenser is coupled with at least one section, which is guided in the housing, of a third fluid circuit, and/or
the evaporator is coupled with the second fluid circuit by way of the at least one section, which is guided in the housing.

9. The refrigerating module according to claim 7, wherein the compressor is coupled with a separate cooling circuit which is led out of the housing by way of corresponding connections.

10. The refrigerating module according to claim 7, wherein the compressor is coupled with the evaporator.

* * * * *